US010683646B2

(12) United States Patent
Pei et al.

(10) Patent No.: US 10,683,646 B2
(45) Date of Patent: Jun. 16, 2020

(54) VIA HOLE MOUNTING APPARATUS

(71) Applicant: FLOWTECH KITCHEN & BATHROOM TECHNOLOGY CO., LTD, Zhongshan, Guangdong (CN)

(72) Inventors: Shangzu Pei, Guangdong (CN); Baoji Su, Guangdong (CN)

(73) Assignee: FLOWTECH KITCHEN & BATHROOM TECHNOLOGY CO., LTD, Zhongshan, Guangdong (CN)

( * ) Notice: Subject to any disclaimer, the term of this patent is extended or adjusted under 35 U.S.C. 154(b) by 0 days.

(21) Appl. No.: 15/767,530

(22) PCT Filed: May 23, 2017

(86) PCT No.: PCT/CN2017/085543

§ 371 (c)(1),
(2) Date: Apr. 11, 2018

(87) PCT Pub. No.: WO2017/206765

PCT Pub. Date: Dec. 7, 2017

(65) Prior Publication Data

US 2018/0305907 A1 Oct. 25, 2018

(30) Foreign Application Priority Data

May 30, 2016 (CN) ..... 2016 1 0373377
May 16, 2017 (CN) ..... 2017 2 0544340 U

(51) Int. Cl.
*E03C 1/04* (2006.01)
*E03C 1/02* (2006.01)

(52) U.S. Cl.
CPC ..... *E03C 1/0401* (2013.01); *E03C 1/04* (2013.01); *E03C 1/02* (2013.01); *E03C 1/0402* (2013.01);

(Continued)

(58) Field of Classification Search
CPC . E03C 1/0401; E03C 1/04; E03C 1/02; E03C 1/0402; Y10T 137/6977; Y10T 137/6014; Y10T 137/9464
See application file for complete search history.

(56) References Cited

U.S. PATENT DOCUMENTS 4,848,395 A * 7/1989 Krippendorf ..... E03C 1/0401 137/359
5,010,922 A * 4/1991 Agresta ..... E03C 1/0401 137/216

(Continued)

FOREIGN PATENT DOCUMENTS

CN 203247651 U 10/2013
CN 203905099 U 10/2014

(Continued)

*Primary Examiner* — Matthew W Jellett
*Assistant Examiner* — Christopher D Ballman
(74) *Attorney, Agent, or Firm* — Muncy, Geissler, Olds & Lowe, P.C.

(57) ABSTRACT

A top mount mechanism is located at the bottom of a mixer, faucet, or tap. The top mounting mechanism includes the following parts: a top mount flange (2), a clamp plate (3), and connecting accessories. The top mount flange (2) and clamp plate (3) are linked via the connecting accessories. The top mount flange is located at the bottom of a mixer, faucet, or tap, flexible hoses from a mixer, faucet, or tap go through the top mount flange (2) and clamp plate (3). Connecting accessories includes a clamp screw (4) and guide pins (5) at the sides, the clamp plate (3) can rotate through a spigot (7) on the guide pins (5), and it is connected to the clamp screw (4) via thread connection, the clamp plate (3) moves up and down sliding along the guide pins (5).

10 Claims, 3 Drawing Sheets

(52) U.S. Cl.
CPC .... *Y10T 137/6014* (2015.04); *Y10T 137/6977* (2015.04); *Y10T 137/9464* (2015.04)

(56) References Cited

U.S. PATENT DOCUMENTS

| | | | | | |
|---|---|---|---|---|---|
| 5,465,749 | A * | 11/1995 | Sauter | E03C 1/0401 | 137/315.15 |
| 5,515,882 | A | 5/1996 | Hennis | | |
| 5,946,746 | A * | 9/1999 | Bloom | E03C 1/0401 | 137/801 |
| 6,138,296 | A * | 10/2000 | Baker | E03C 1/0401 | 4/678 |
| 6,209,153 | B1 * | 4/2001 | Segien, Jr. | E03C 1/0401 | 137/359 |
| 6,301,728 | B1 * | 10/2001 | Pilatowicz | E03C 1/0401 | 137/360 |
| 6,328,059 | B1 * | 12/2001 | Testori | E03C 1/0401 | 137/315.12 |
| 6,334,226 | B1 * | 1/2002 | Tokunaga | E03C 1/0401 | 4/675 |
| 6,370,712 | B1 * | 4/2002 | Burns | E03C 1/0401 | 137/359 |
| 6,405,749 | B1 * | 6/2002 | Bloom | E03C 1/0401 | 137/359 |
| 6,434,765 | B1 * | 8/2002 | Burns | E03C 1/0401 | 137/359 |
| 6,484,330 | B2 * | 11/2002 | Gray | E03C 1/0401 | 4/676 |
| 6,792,629 | B2 * | 9/2004 | Nelson | E03C 1/0401 | 4/695 |
| 7,003,818 | B2 * | 2/2006 | McNerney | E03C 1/0401 | 4/675 |
| 7,175,158 | B2 * | 2/2007 | Thomas | E03C 1/0401 | 137/315.41 |
| 7,828,013 | B2 * | 11/2010 | Lin | E03C 1/0401 | 137/801 |
| 7,896,025 | B2 * | 3/2011 | Hanson | E03C 1/04 | 137/454.6 |
| 7,979,929 | B2 * | 7/2011 | Vogel | E03C 1/0401 | 4/695 |
| 8,407,828 | B2 * | 4/2013 | Vogel | E03C 1/23 | 4/678 |
| 8,763,175 | B2 * | 7/2014 | Li | E03C 1/0402 | 137/359 |
| 8,899,259 | B2 * | 12/2014 | Jonte | E03C 1/0402 | 137/315.12 |
| 9,074,357 | B2 * | 7/2015 | Meehan | E03C 1/0401 | |
| 9,243,388 | B2 * | 1/2016 | Sansum | E03C 1/0401 | |
| 9,487,936 | B2 * | 11/2016 | Sallah | E03C 1/0401 | |
| 2006/0157109 | A1 * | 7/2006 | Vu | E03C 1/0401 | 137/216 |
| 2007/0044232 | A1 * | 3/2007 | McNerney | E03C 1/0401 | 4/695 |
| 2008/0110512 | A1 * | 5/2008 | Giagni | E03C 1/04 | 137/625.4 |
| 2008/0289697 | A1 * | 11/2008 | Lin | E03C 1/0401 | 137/315.12 |
| 2009/0277520 | A1 * | 11/2009 | Wang | E03C 1/0401 | 137/801 |
| 2012/0047713 | A1 * | 3/2012 | Julian | E03C 1/0401 | 29/525.11 |
| 2014/0116553 | A1 * | 5/2014 | Schoolcraft | E03C 1/057 | 137/801 |
| 2016/0024762 | A1 * | 1/2016 | Hsu | E03C 1/0401 | 4/619 |

FOREIGN PATENT DOCUMENTS

| | | | | |
|---|---|---|---|---|
| CN | 104674904 | A | 6/2015 | |
| CN | 204690849 | U | 10/2015 | |
| EP | 3048206 | A1 * | 7/2016 | E03C 1/0402 |
| JP | 2007291605 | A | 11/2007 | |

* cited by examiner

VIA HOLE MOUNTING APPARATUS

INVENTION FIELD

The invention is in relation to installation, in particular installation mechanism of fixing the mixer, tap or faucet above the surface of a sink, basin and or bench mount.

TECHNICAL BACKGROUND

Some part of the equipment installation involves getting certain parts of the equipment through a counter or table top, then connects with other accessories and fixes this connection on a table top. Under the table top it is usually narrow and dark. Installers often finds it difficult to install, hence lower efficiency.

For example to install a conventional mixer, tap, or faucet on a table top, the flexible hoses have to pass through the table top hole, then utilize a nut and thread connection to fix the tap on the table top. To fasten or unfasten the nut, tool such as a spanner is required. Installers have to go under the table top and fasten or unfasten nut in this limited space, it is a very inconvenient, time and energy consuming job.

There are some existing top mounting mechanisms, which includes mounting flange and clamp plate as well, but the existing designs do not fix and secure the equipment effectively.

SUMMARY OF THE INVENTION

The main objective of the invention is to provide a top mount installation mechanism to solve the inconveniences caused by conventional installation as well as the disadvantages of current existing top mount design by controlling the clamp plate moving up and down through guide pins.

The objective is achieved by applying the following technical solution. A top mount mechanism, the top mount mechanism is located at the bottom of a mixer, faucet, or tap. The top mounting mechanism includes the following parts: a top mount flange, a clamp plate, and connecting accessories. The top mount flange and clamp plate are linked via the connecting accessories. The top mount flange is located at the bottom of a mixer, faucet, or tap. Flexible hoses from a mixer, faucet, or tap go through the top mount flange and clamp plate. Connecting accessories includes a clamp screw and guide pins at the sides, the clamp plate can rotate through a spigot on the guide pins, and it is connected to the clamp screw via thread connection.

It is preferable that, at both ends of the clamp plate there are pivot holes, where the spigot ends will be fitted; the spigot has a threaded hole at the center of the vertical axis, clamp screw engages with the threaded hole in the clamp spigot, spigot moves up and down along the guide pins vertically and drives the clamp plate to move up and down sliding along the guide pins. This allows secure fastening of the mechanism to different size bench thicknesses.

It is preferable that, the end of the spigot has 2 guide pin holes, one on either side of the clamp screw hole. The guide pins have open ends, the open ends are matched to the guide pin holes.

It is preferable that, the end of the spigot has holes at either side so that the guide pins go through them.

It is preferable that, one of the spigot ends is designed to have a cover plate, and the other end is mounted with a spring, this end of spigot has a spring hole. The clamp plate end which connects to the spigot spring also has a spring hole, so that the spring connects both spigot and clamp plate together.

It is preferable that, the top mount flange has a tap body locating pin, on the bottom of the rim to correspond with the flange pin location on the mixer, tap or faucet body.

It is preferable that, the outer surface of the top mount flange has at least one groove, where the girth member is seated.

It is preferable that, girth member can be either o-ring or plastic sleeve which fits around the ring groove.

This invention structure allows setting the clamp plate to move up and down along the guide pins and a spring returning the clamp plate to the correct position automatically. This makes the installation of a mixer, tap or faucet above the top surface of a sink, basin and or bench mount much easier.

1. Tap Body
2. Top Mount Flange
3. Clamp Plate
4. Clamp Screw
5. Guide Pin
6. Pivot Hole
7. Spigot
8. Spigot Cover Plate
9. Spigot Guide Pin Hole
10. Guide pins opened-end
11. Locking Screw
13. Spring
14. Anti slippery gasket
15. Spring hole
16. Tap Body Locating Pin
17. Flange Pin Location
18. Ring Groove
19. Plastic Sleeve
20. O-ring
21. Grub Screw Hole
22. Grub Screw
23. Clamp Screw Hole

Embodiment

Figure 1:
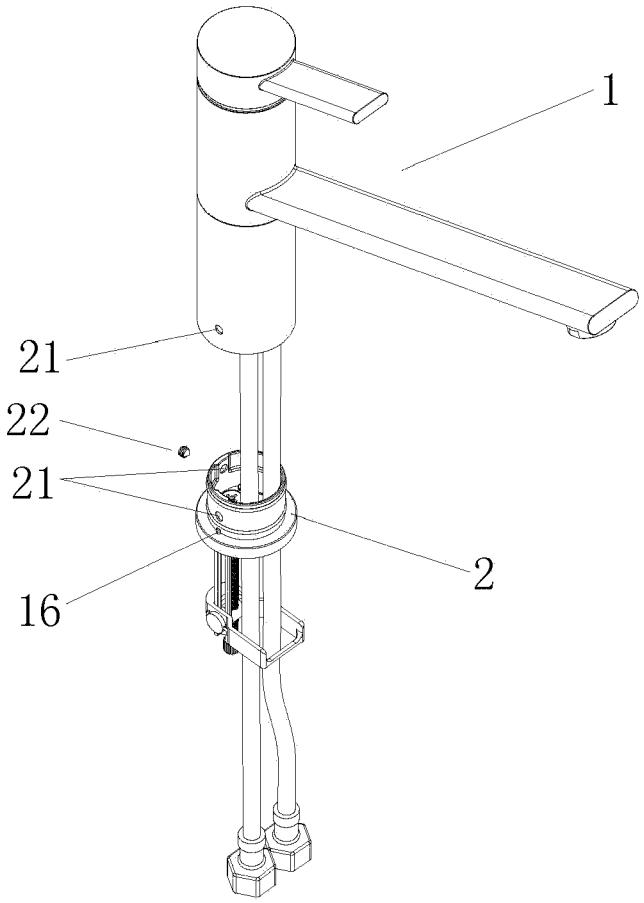
FIG. 1 Perspective view of a top mount mechanism with a tap body
Figure 2:
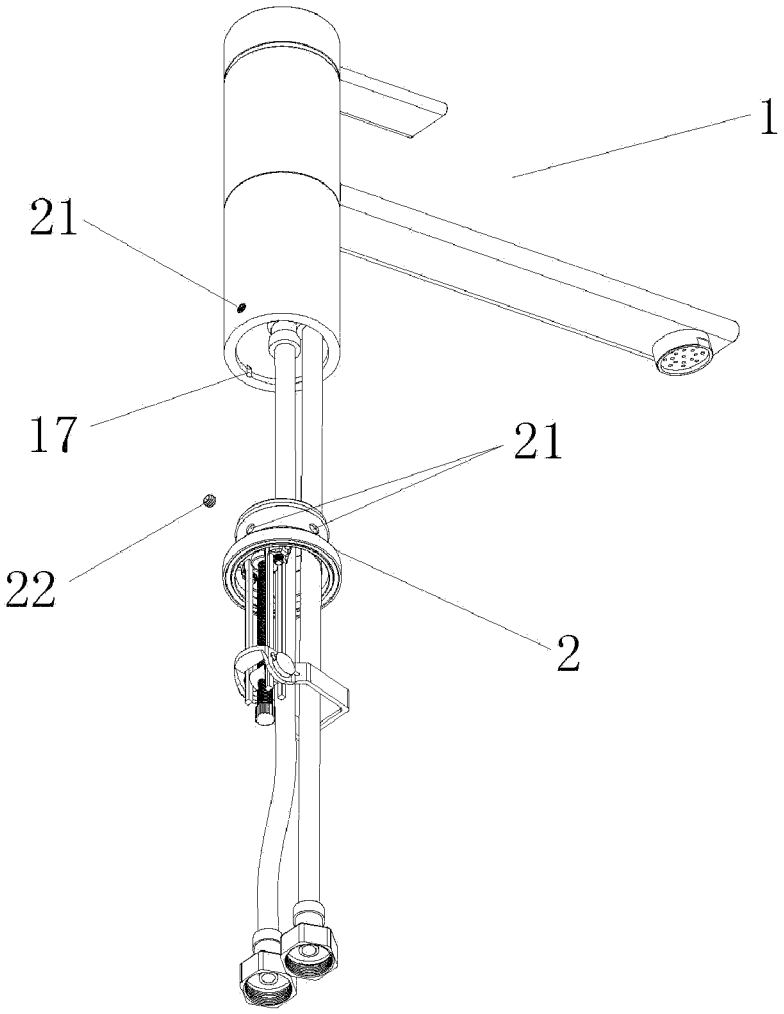
FIG. 2 Perspective view of a top mount mechanism with a typical tap body, but which is not limited to this style FIG. 3 Exploded Diagram of a top mount mechanism assembly From FIG. 1 to FIG. 3.

With reference to FIG. 1, 2, 3 shows a top mount mechanism at the bottom of tap body (1) in accordance with invention comprises a top mount flange (2), clamp plate (3), and connection accessories. Top mount flange (2) and clamp plate (3) are connected through the connection accessories, the top mount flange (2) is fitted at the bottom of the tap body (1), flexible hoses from tap body (1) pass through the top mount flange (2) and clamp plate (3); connecting accessories includes clamp screw (4) and guide pins (5) at the sides, the clamp plate (3) can rotate through a spigot on the guide pins (5), and it is connected to the clamp screw (4) via thread connection; guide pins (5) are fixed at the bottom of top mounting flange (2) via locking screws (11).

During installation, lift the clamp plate (3) to a vertical position to allow the clamp plate (3) to pass through the hole in the sink or bench top. The spring loaded clamp plate (3) will automatically return to the horizontal position which is necessary to ensure proper clamping to the underside of the sink or bench top. Place the top mount flange (2) into position and tighten the clamp screw (4). This will cause the clamp plate (3) to move upward against the guide pin (5), until the clamp plate (3) has fastened up against the underside of the mounting surface. Place the tap body (1) into position on the mounting flange (2) that is now securely mounted to the sink or bench top.

Figure 3:
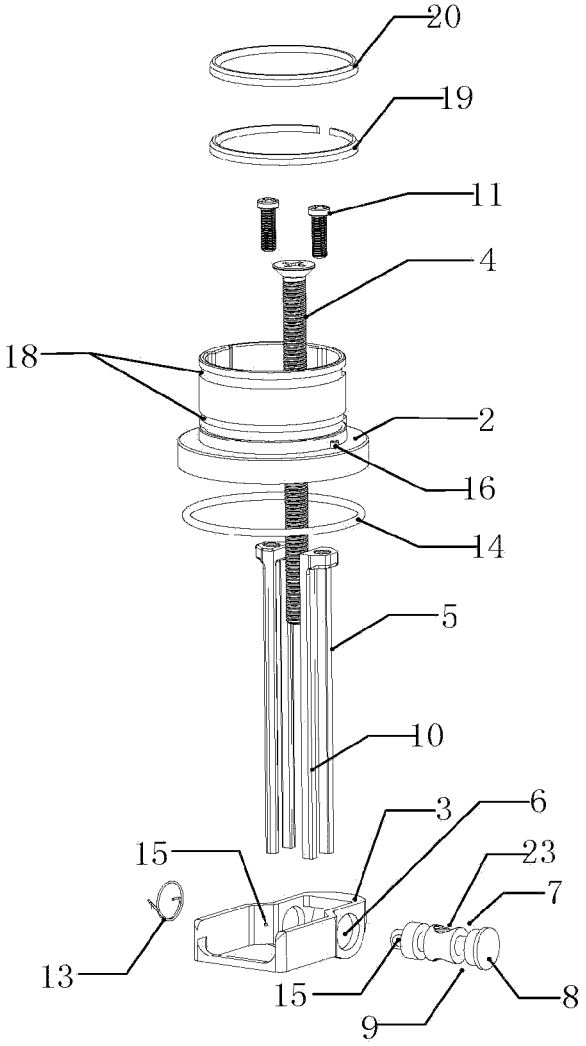

As shown in FIG. 3, clamp plate ends have pivot holes (6), spigot (7) lies in the pivot holes (6), spigot (7) has a threaded clamp screw hole (23) at the center of the vertical axis, clamp screw (4) engages with threaded hole (23) in the clamp spigot, spigot (7) moves up and down vertically sliding along the guide pin (5).

The connection between guide pins (5) and spigot (7) has various structure:

Example 1, at the end of spigot (7) there are two spigot guide pin holes (9), guide pins (5) have opened-ends (10), the opened-ends (10) are matched to the guide pin holes (9).

Example 2, both the ends of the spigot (7) there are two holes where the guide pins (5) pass through.

The spigot (7) slides along the guide pins (5), by using the clamp screw (4) the clamp plate (3) moves up and down vertically; at the bottom of clamp screw (4) there is a cap nut to prevent the clamp plate (3) from falling out of the clamp screw (4) in a reverse rotation.

At one end of the spigot there is cover plate (8), the other end of the spigot is fitted with spring (13), this end has a spring hole (15), the clamp plate end (3) which connects to the spigot spring also have a spring hole (15), so that the spring (13) connects both spigot (7) and clamp plate (3) together.

The spring (13) at the spigot (7) will ensure the clamp plate (3) is always 90° to the guide pins (5). During installation clamp plate (3) will be lifted up to a vertical position to allow the clamp plate (3) to pass through the tap hole, the spring loaded clamp plate (3) will automatically return to the horizontal position once released, this will ensure the top mount flange (2) and clamp plate (3) is able to clamp to the mounting surface in the correct position and make a smooth fit.

Top mount flange (2) has a tap body locating pin (16) on the bottom of the rim, this tap body locating pin (16) corresponds to flange pin location (17) on the tap body (1), there is at least one tap body location pin (16) and flange pin location (17) is arranged. Bottom of tap body (1) and top mounting flange (2) has a grub screw hole (21), tap body (1) will be securely attached to the top mount flange (2) by tightening the grub screw (22) through grub screw hole (21).

The outer surface of the top mount flange (2) has at least one ring groove (18), where the girth member is seated, girth member can be either plastic sleeve (19) or O-ring (20). As shown in FIG. 3, there are two ring grooves (18), plastic sleeve (19) or O-ring (20) sit in the ring grooves (18).

The bottom of top mount flange (2) has a ring groove which fits the anti slippery gasket (14), this is to increase the friction between the counter top and the top mount flange (2) so that it will not slides on the counter top, to ensure more secure fixing of the top mounting mechanism on counter top.

Even though numerous characteristics and advantages of the present invention have been set forth in the forgoing description, together with details of the structure and function of the invention, the disclosure is illustrative only, and changes may be made in detail.

The invention claimed is:

1. A type of top mounting mechanism, the top mount mechanism fits onto the bottom of the mixer, tap or faucet body comprising:

a top mount flange (2);

a clamp plate (3); and connection accessories;

characterized in that the top mount flange (2) and the clamp plate (3) are connected through the connection accessories, whereby said top mount flange (2) is positioned on a hole from top of a sink or bench top, and a flexible hoses pass through the top mount flange (2) and the clamp plate (3), and connect to the mixer, tap or faucet body; and the connection accessories comprise of a clamp screw (4) and guide pins (5), wherein the clamp plate (3) has a spring (13) to connect a spigot (7) to the clamp plate (3) to receives the flexible hoses, whereby the spigot (7) allows the clamp plate (3) to position the flexible hoses in-line with the tap or faucet body at bottom of the guide pin (5) through the clamp plate for easing installation of the top mounting mechanism, by lifting the clamp plate (3) in a vertical position to allow the flexible hoses that are in-line with the guide pin (5) to pass through the hole from top of the sink or bench top, and returning the clamp plate (3) to the horizontal position to clamp to underside of the sink or bench top of the hole by sliding vertically up along the guide pin (5) and the flexible hoses to fasten the top mount flange (2) onto the sink or bench top.

2. The top mount mechanism according to claim 1, wherein the clamp plate (3) is formed with two pivot holes (6) at both ends, where the spigot end is fitted; the spigot (7) is having a threaded hole (23) at the center of the vertical axis, the clamp screw (4) is engaged with a clamp screw hole (23) through the thread, spigot (7) moves up and down vertically sliding along the guide pin (5).

3. The top mount mechanism according to claim 2, wherein the end of the spigot (7) is having two spigot guide pin holes (9), one on each side of the clamp screw hole (23), and the guide pins (5) have opened-ends (10), in which the opened-ends (10) matching to the spigot guide pin holes (9).

4. The top mount mechanism according to claim 2, wherein each of both ends of the spigot (7) or the clamp plate (3) has a guide hole for the guide pins (5) to pass through.

5. The top mount mechanism according to claim 2, wherein at one end of the spigot (7) is designed to have a cover plate (8), and the other end is mounted with a spring (13), this end of spigot has a spring hole (15), the clamp plate (3) end which connects to the spigot spring (13) has a spring hole (15), so that the spring (13) connects both spigot (7) and clamp plate (3) together.

6. The top mount mechanism according to claim 1, wherein the top mount flange (2) has a tap body locating pin (16) on the bottom of the rim, the tap body locating pin (16) corresponds to a flange pin location (17) on the tap body (1).

7. The top mount mechanism according to claim 1, wherein the outer wall of the top mount flange (2) has a least one groove, where a girth member is seated.

8. The top mount mechanism according to claim 7, wherein the girth member is either O-ring (20) or plastic sleeve (19), the O-ring (20) or plastic sleeve (19) sits in a ring groove (18).

9. The top mount mechanism according to claim 1, wherein the clamp plate (3) receive the flexible hoses for easing installation the top mounting mechanism, by positioning the flexible hoses in-line at bottom of the guide pin (5) to pass through the hole from top of the sink or bench top.

10. The top mount mechanism according to claim 1, wherein the clamp plate (3) receive the flexible hoses for positioning the flexible hoses in-line with the tap or faucet body or the guide pin (5), by sliding vertically down along the guide pin (5).

* * * * *